US007036951B2

(12) United States Patent
St-Hilaire

(10) Patent No.: US 7,036,951 B2
(45) Date of Patent: May 2, 2006

(54) SWIMMING POOL STEPS WITH LIGHT

(76) Inventor: Normand St-Hilaire, 1125, 431ème Avenue, St-Hippolyte, Quebec (CA) J8A 3P5

( * ) Notice: Subject to any disclaimer, the term of this patent is extended or adjusted under 35 U.S.C. 154(b) by 3 days.

(21) Appl. No.: 10/780,194

(22) Filed: Feb. 17, 2004

(65) Prior Publication Data

US 2005/0180127 A1 Aug. 18, 2005

(51) Int. Cl.
*F21V 31/00* (2006.01)

(52) U.S. Cl. ..... 362/101; 362/96; 362/147; 362/146; 362/276

(58) Field of Classification Search ..... 362/96, 362/147, 101, 146, 276
See application file for complete search history.

(56) References Cited

U.S. PATENT DOCUMENTS 3,845,291 A * 10/1974 Portyrata ..... 362/192
6,130,615 A * 10/2000 Poteet ..... 340/573.6
6,261,186 B1 * 7/2001 Henry ..... 472/128
6,528,954 B1 * 3/2003 Lys et al. ..... 315/291
6,967,448 B1 * 11/2005 Morgan et al. ..... 315/295
2003/0190967 A1 * 10/2003 Henry ..... 472/128

* cited by examiner

*Primary Examiner*—Sandra O'Shea
*Assistant Examiner*—Anabel Ton
(74) *Attorney, Agent, or Firm*—Eric Fincham

(57) ABSTRACT

A light assembly for a swimming pool which has a stair assembly and a pump recirculating water in the swimming pool, the system comprising a motion detector which is located proximate the stair assembly, a light mounted proximate the stair assembly, and a generator arranged to generate electricity from the circulating water, the arrangement being such that when the motion detector detects motion on the stairs, the light is activated for a predetermined period of time. The system can function as a safety system, both from the point of view of providing illumination for the pool user and also as a visual alarm in the instance where children activate the system.

5 Claims, 3 Drawing Sheets

SWIMMING POOL STEPS WITH LIGHT

FIELD OF THE INVENTION

The present invention relates to swimming pools, and more particularly, relates to swimming pool accessories.

BACKGROUND OF THE INVENTION

The use of backyard swimming pools is well established and extremely popular. As such, many accessories have been developed for use with such residential swimming pools.

The use of lights with swimming pools is well known in the art. The lights are usually mounted within the wall of the swimming pool and connected to a suitable power source which is usually the electric power from the residence. Currently, such lights are fairly expensive since, as will readily be understood, precautions must be taken with the presence of water near electrical power.

The lights function both aesthetically and also to permit visual acuity underwater. Particularly where children are involved, the lights permit an adult supervisor to readily spot any children in the swimming pool.

SUMMARY OF THE INVENTION

It is an object of the present invention to provide a swimming pool light which operates at a low voltage and which is automatically triggered upon someone entering the pool.

According to one aspect of the present invention, there is provided a light system for a swimming pool having a stair assembly and a pump for circulating water in the swimming pool, the system comprising a motion detector situated proximate the stair assembly, a light mounted proximate the stair assembly, a generator arranged to generate electricity from the circulating water, the arrangement being such that when the motion detector detects motion, the light is activated for a predetermined period of time.

The device of the present invention may be used with either above ground or in ground swimming pools. It will normally be more widely utilized with above ground swimming pools as they are the type which normally have separate stairs or ladders.

The light can be incorporated in a set of stairs as will be described in the preferred embodiment of the present invention. Naturally, it will be understood that the same arrangement could be employed with a ladder going into and out of the pool. However, the use of the steps is quite popular in those arrangements wherein a deck or other like structure is built around at least a portion of the periphery of the swimming pool.

The light may be any suitable and preferably is of the low voltage type to minimize any safety concerns. Such low voltage lights are well known in the art and hence will not be described in greater detail herein. It will also be understood that the circuitry may incorporate timers and the like which are user adjustable.

The generator is operable to generate electric current to power the light. The generator preferably includes a water turbine which will be rotated by the water recirculating system of the swimming pool. The water turbine may be conveniently incorporated in one of the hoses leading from the pump of the water recirculating system though naturally other equivalent arrangements could be employed.

BRIEF DESCRIPTION OF THE DRAWINGS

Having thus generally described the invention, reference will be made to the accompanying drawings illustrating an embodiment thereof, and wherein.

DESCRIPTION OF THE PREFERRED EMBODIMENTS

Figure 1:
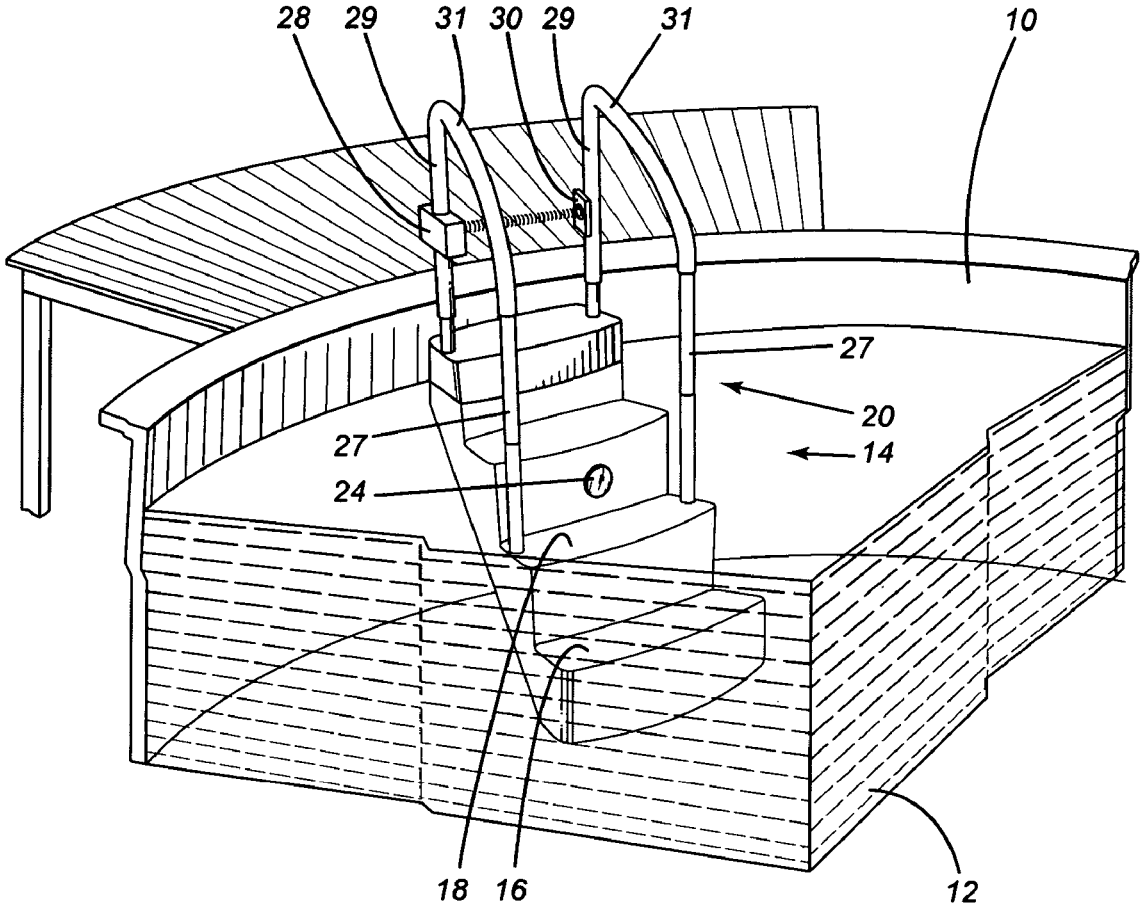
FIG. 1 is a perspective view of a portion of a swimming pool incorporating the system of the present invention.
Figure 2:
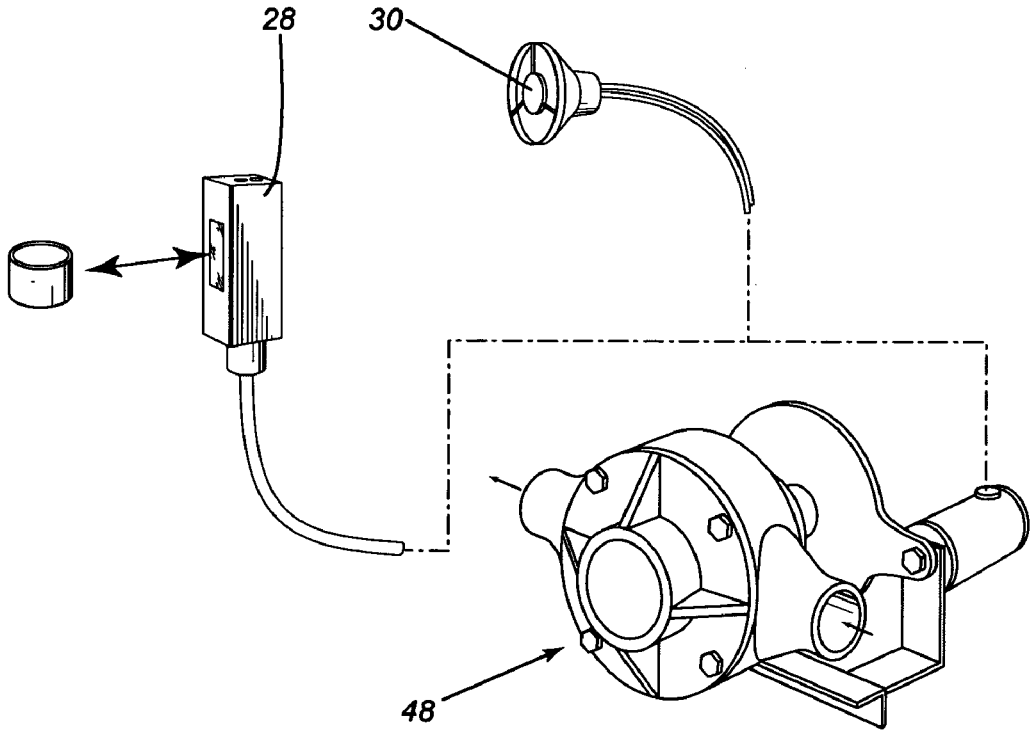
FIG. 2 is a schematic view illustrating some of the various components of the system according to the present invention.

Referring to the drawings in greater detail and by reference characters thereto, there is illustrated in FIG. 1 a portion of an above ground swimming pool having a stair assembly therein.

As illustrated, there is an above ground swimming pool having a side wall 10 and a bottom surface 12. A stair assembly generally designated by reference numeral 14 is placed within the pool adjacent to side wall 10.

Stair assembly 14 includes a plurality of steps 16 and risers 18 in a conventional manner. A pair of railings generally designated by reference numeral 20 are provided on either side of the stair assembly 14. Each railing 20 includes a front post 27, a rear post 29 and a handrail 31 extending therebetween. In the illustrated embodiment, there is also provided a deck 22 extending about a portion of the periphery of the side wall 10.

According to the present invention, there is provided a low voltage light 24 which is integrated into one of the risers 18.

The system of the present invention also includes a motion detector 28 mounted on one of the front posts 27 of the handrail 20 and a reflector 30 on the other front post. Motion detector 28 and reflector 30 are well known in the art and accordingly, are not described in detail herein.

Figure 4:
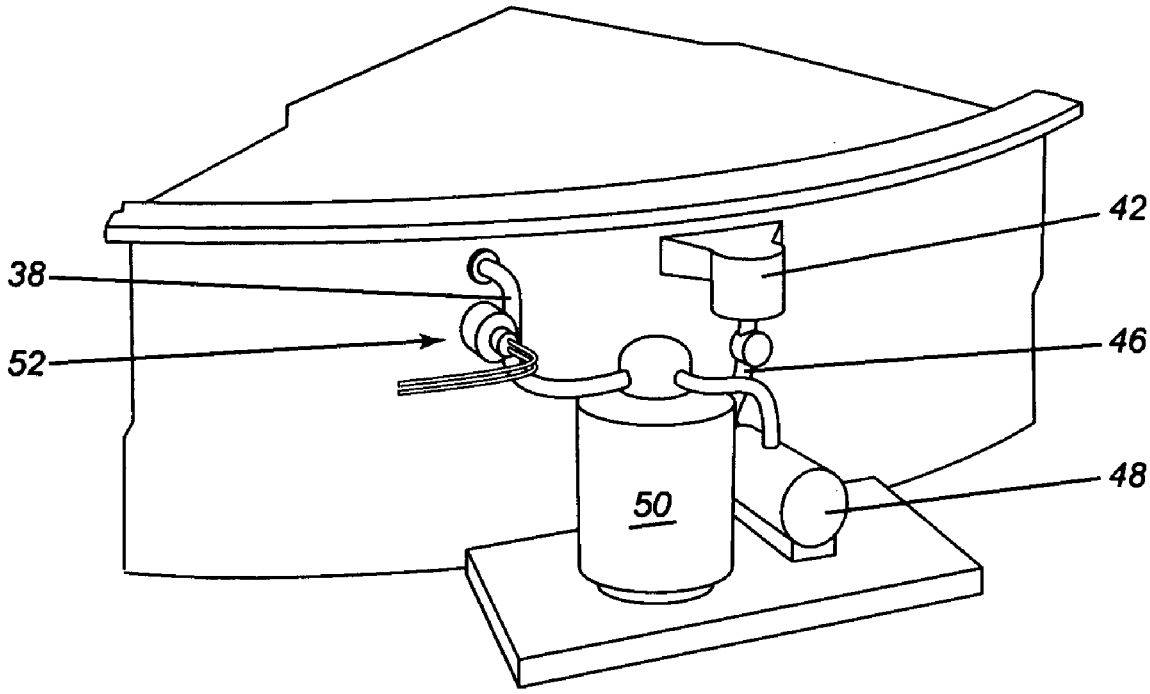
FIG. 4 is a perspective view showing mounting of the turbine.
Figure 5:
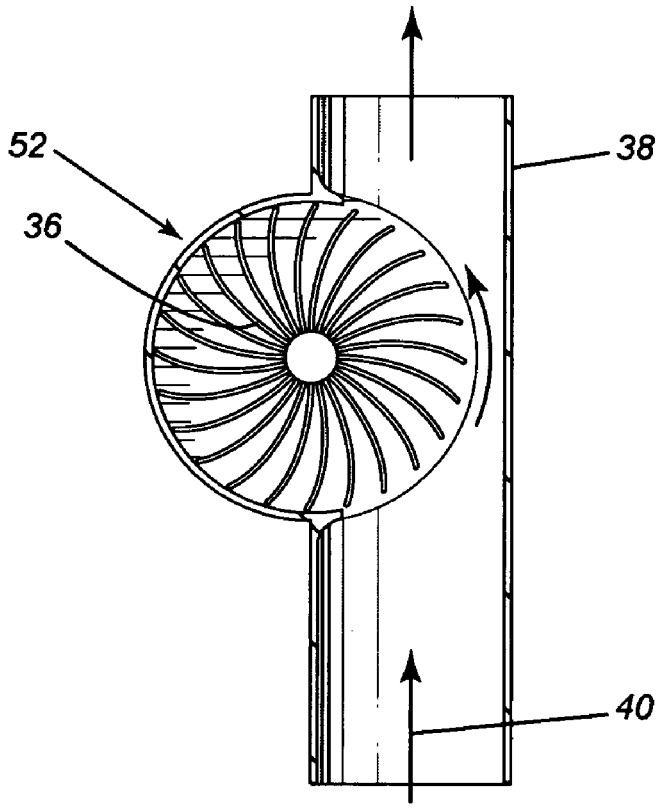
FIG. 5 is a cross sectional view of the turbine.

The system will include the conventional components for an above ground pool and thus, as shown in FIG. 4, there is provided a skimmer inlet 42 by means of which water 46 is pumped by electric motor 48 through a filter 50. A generator generally designated by reference numeral 52 is mounted on output conduit 38.

Figure 3:
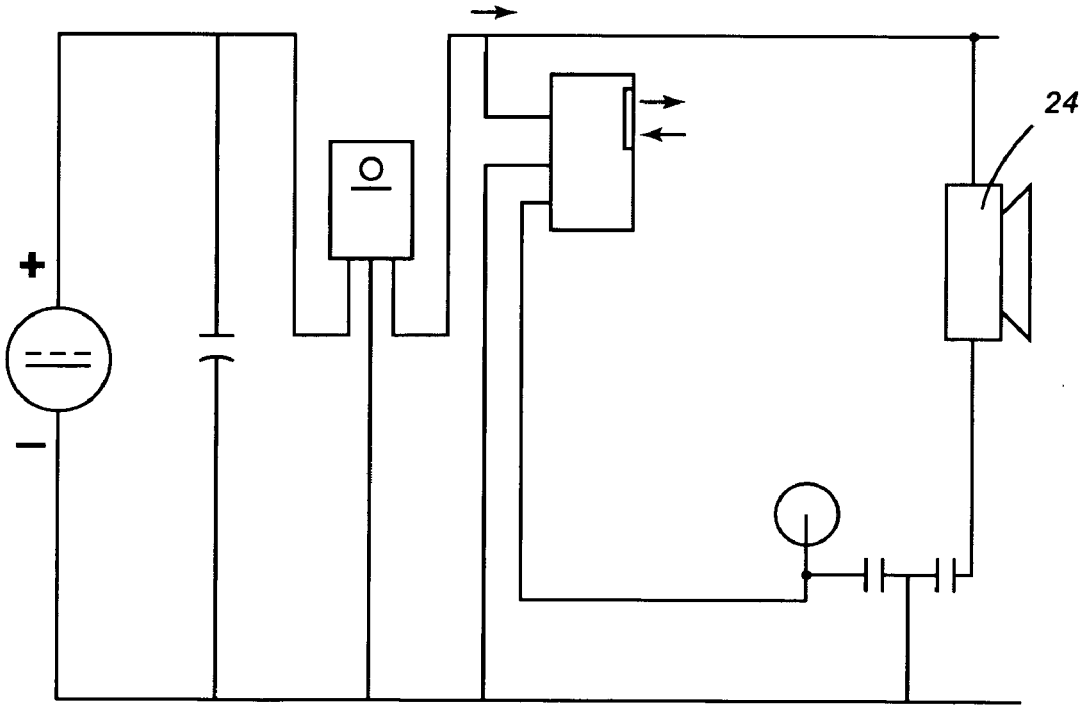
FIG. 3 is an electrical schematic of the electrical circuit.

As may be seen in FIG. 3, generator 52 includes a turbine wheel 36 which is rotated by means of moving water within conduit 38 as shown by arrows 40. Again, such generators are well known in the art.

The above described system is useful from many points of view. It can function to assist the adult user of the swimming pool by providing illumination in the area around the steps. This system can also function to alert an observer that somebody is entering the pool. This can be particularly useful when small children are present. Indeed, in such an instance, the system could incorporate an audio output which would include a noise emitting device.

The circuitry for the system is not complex. It can incorporate a timer which will maintain the lights on for a predetermined period of time after activation. If desired, this amount of time could be user adjustable. The system will operate at a low voltage, preferably under a 24 volts and even more preferably around approximately 12 volts as there are many commercially available products adapted for this voltage.

It will be understood that the above described embodiment is for purposes of illustration only and that changes and modifications may be made thereto without departing from the spirit and the scope of the invention.

I claim:

1. A light system for a swimming pool having a stair assembly, and a pump for circulating water in the swimming pool the system comprising:

first and second safety rails situated proximate said stair assembly;

a motion detector mounted on said first safety rail, said motion detector emitting a beam between said safety rails;

a generator arranged to generate electrical output from said circulating water;

a light mounted proximate said stair assembly, said light being operatively connected to said electrical output;

the arrangement being such that when said motion detector detects motion between said safety rails, said light is activated for a predetermined period of time.

2. The system of claim 1 wherein said stair assembly includes risers and treads, said light being incorporated in one of said risers.

3. The system of claim 1 wherein said generator includes a turbine wheel.

4. The system of claim 3 wherein said turbine wheel is mounted so as to be powered from water flow through a hose associated with said pump.

5. The system of claim 1 wherein said generator is arranged to generate electricity below about 24 volts.

* * * * *